US008943797B2

(12) United States Patent
Hayman et al.

(10) Patent No.: US 8,943,797 B2
(45) Date of Patent: Feb. 3, 2015

(54) CYLINDER HEAD WITH SYMMETRIC INTAKE AND EXHAUST PASSAGES

(75) Inventors: Alan W. Hayman, Romeo, MI (US); Eric C. Douse, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/351,539

(22) Filed: Jan. 17, 2012

(65) Prior Publication Data

US 2012/0138008 A1 Jun. 7, 2012

Related U.S. Application Data

(63) Continuation of application No. 13/004,986, filed on Jan. 12, 2011.

(60) Provisional application No. 61/295,257, filed on Jan. 15, 2010.

(51) Int. Cl.
*F01N 1/18* (2006.01)

(52) U.S. Cl.
USPC ..... 60/262; 60/323; 60/313; 123/193.5

(58) Field of Classification Search
USPC ..... 123/193.5, 41.35; 60/282, 323, 313
See application file for complete search history.

(56) References Cited

U.S. PATENT DOCUMENTS 3,109,416 A 11/1963 Rose et al.
3,791,144 A * 2/1974 Lang ..... 60/278
4,037,408 A * 7/1977 Ozawa ..... 60/282
4,086,763 A * 5/1978 Matsushita et al. ..... 60/282
4,106,471 A * 8/1978 Nakajima et al. ..... 123/198 F
4,114,373 A * 9/1978 Sakai et al. ..... 60/282
4,123,902 A * 11/1978 Iida ..... 60/282
4,177,640 A * 12/1979 Kuroda et al. ..... 60/274
4,218,880 A * 8/1980 Kuroda et al. ..... 60/278
4,258,547 A * 3/1981 Fenn ..... 60/272
4,262,639 A * 4/1981 Motosugi et al. ..... 123/184.45
4,480,600 A 11/1984 Gill
4,805,403 A * 2/1989 Bowman et al. ..... 60/320
4,889,083 A 12/1989 Honma et al.

(Continued)

FOREIGN PATENT DOCUMENTS

CN 1416502 A 5/2003
CN 1935585 A 3/2007

(Continued)

OTHER PUBLICATIONS

DE Office Action dated Nov. 5, 2012 for DE Patent Application No. 10 2011 008 609.9; 4 pages.

(Continued)

*Primary Examiner* — M. McMahon
(74) *Attorney, Agent, or Firm* — Cantor Colburn LLP

(57) ABSTRACT

A cylinder head for an internal combustion engine defines first and second intake passages for supplying air through first and second intake valve openings to first and second cylinders. The cylinder head also defines first and second exhaust passages for conveying first and second streams of exhaust gas from first and second exhaust valve openings associated with first and second cylinders. The first exhaust valve opening is disposed outboard of the first intake valve opening, and the second exhaust valve opening is disposed outboard of the second intake valve opening.

17 Claims, 4 Drawing Sheets

(56) References Cited

U.S. PATENT DOCUMENTS

| | | | |
|---|---|---|---|
| 5,003,932 | A | 4/1991 | Duncan |
| 5,046,578 | A | 9/1991 | Nakayama et al. |
| 5,181,491 | A | 1/1993 | Izumi et al. |
| 5,339,918 | A | 8/1994 | Nakayama et al. |
| 5,492,088 | A | 2/1996 | Ohrnberger |
| 5,531,291 | A | 7/1996 | Sato et al. |
| 5,613,470 | A | 3/1997 | Shiomi et al. |
| 5,630,386 | A | 5/1997 | Uchida |
| 5,660,154 | A | 8/1997 | Fields |
| 5,901,677 | A | 5/1999 | Ohrnberger et al. |
| 6,095,105 | A | 8/2000 | Lohr et al. |
| 6,161,513 | A | 12/2000 | Lohr et al. |
| 6,357,401 | B1 | 3/2002 | Moriyama et al. |
| 6,510,912 | B1 | 1/2003 | Atsuumi |
| 6,745,730 | B2 | 6/2004 | Yamashita |
| 6,941,914 | B2 | 9/2005 | Snyder et al. |
| 7,070,526 | B2 | 7/2006 | Lawrence |
| 7,131,416 | B2 | 11/2006 | Sasaki et al. |
| 7,438,040 | B2 | 10/2008 | Sugita et al. |
| 7,757,655 | B2 | 7/2010 | Inui et al. |
| 7,770,555 | B2 | 8/2010 | Matsuda |
| 7,827,955 | B2 | 11/2010 | Matsuda et al. |
| 8,256,402 | B2 * | 9/2012 | Yamagata et al. ..... 123/559.1 |
| 2003/0019464 | A1 | 1/2003 | Morii et al. |
| 2004/0206567 | A1 | 10/2004 | Kato et al. |
| 2005/0006168 | A1 | 1/2005 | Iwasaka et al. |
| 2005/0257765 | A1 * | 11/2005 | Saitoh et al. ..... 123/193.5 |
| 2006/0144354 | A1 | 7/2006 | Tanaka et al. |
| 2006/0283418 | A1 | 12/2006 | Matsuda et al. |
| 2008/0210189 | A1 | 9/2008 | Boyes et al. |
| 2011/0209937 | A1 | 9/2011 | Belzile et al. |

FOREIGN PATENT DOCUMENTS

| | | | |
|---|---|---|---|
| DE | 60020493 | T2 | 10/2005 |
| DE | 102008020423 | A1 | 10/2009 |
| JP | 2000274321 | A | 10/2000 |
| WO | 2009096977 | A1 | 8/2009 |

OTHER PUBLICATIONS

Chinese Office Action for Application No. 201110052804.2 dated Apr. 9, 2013; 8 pages.

Chinese Office Action for CN Application No. 201110052804.2, dated Jul. 15, 2014, pp. 1-6.

* cited by examiner

CYLINDER HEAD WITH SYMMETRIC INTAKE AND EXHAUST PASSAGES

CROSS REFERENCE TO RELATED APPLICATIONS

This application is a continuation of, and claims priority from, pending U.S. patent application Ser. No. 13/004,986 filed on Jan. 12, 2011, which claims priority from U.S. Provisional Patent Application Ser. No. 61/295,257 filed on Jan. 15, 2010, the contents each of which are incorporated herein by reference thereto.

FIELD OF THE INVENTION

The subject invention relates to internal combustion engines, and more particularly to a cylinder head for an internal combustion engine wherein the cylinder head defines intake and exhaust passages that are disposed symmetrically about a central plane of symmetry positioned between a pair of engine cylinders.

BACKGROUND

An internal combustion engine (engine) extracts work from a combusted mixture of fuel and air. In one common form, an engine includes one or more reciprocating pistons that drive a crankshaft. The pistons are slide-ably disposed within cylinders formed in a cylinder block. A cylinder head is secured to the cylinder block so as to provide a controllably sealable chamber for the compression, combustion, and expansion of the mixture of fuel and air. The cylinder head defines a combustion chamber for each cylinder above the top of the respective piston. The cylinder head also defines passages for the intake of air and fuel into each cylinder and for the discharge of combustion products from each cylinder.

As each of the pistons reciprocates within its respective cylinder, it proceeds through a series of strokes including an intake stroke, during which the respective cylinder receives a supply of combustible fuel and air, and an exhaust stroke, during which expanded products of the combusted fuel and air mixture are discharged from the cylinder.

An intake manifold provides intake runners for carrying the supply of air (and, optionally, combustible fuel) to each intake passage of the cylinder head. An exhaust manifold carries discharged products of combustion from the exhaust passages of the cylinder head. The exhaust manifold gathers exhaust gases from the various exhaust passages of the cylinder head, carries the exhaust gasses through a set of corresponding exhaust runners, and collects them into a single stream of exhaust gas. The exhaust manifold is typically a separate component coupled to the cylinder head with threaded fasteners. The exhaust manifold routes the gases toward the catalysts and mufflers of the exhaust system.

Frequently, the cylinder head is detachable from the top of the engine and contains spark plugs and the intake and exhaust valve openings associated with each of the cylinders of the cylinder block. In some embodiments, the cylinder head also contains one or more fuel injectors for injecting fuel into respective cylinders and a camshaft for opening and closing the intake and exhaust valve openings during appropriate time intervals. The cylinder head and cylinder block may include a series of coolant passages that facilitate circulation of coolant. Coolant is circulated through the coolant passages within the cylinder block and the cylinder head to extract heat, particularly from the vicinity of the cylinders, the combustion chamber and the valve-train components.

Environmental sustainability, increasing global energy demand, increases in energy costs, and increasing demand for independent, cost-effective transportation is driving vehicle and power-train designers to produce smaller and more fuel-efficient vehicles. Thus, inline engines with only three or four cylinders are increasingly being used to power medium to small sized vehicles. At the same time, the inline cylinder configurations commonly used for such engines tend to define minimum vehicle space requirements for packaging the engines. As a result, narrow-angle, V-configured engines are increasingly being considered due to the packaging advantages they offer. By staggering pistons in offset banks, V-configured engines offer additional pistons (and power) without unnecessarily increasing engine length. Unfortunately, engine height may suffer in such engines due to the use of a single cylinder head with a height beyond that required for an inline engine.

Accordingly, as engine manufacturers continuously strive to improve engine operating efficiency and to reduce manufacturing costs, it is desirable to have engine configurations and components offering improved operating efficiencies, improved packaging compactness, improved cooling effectiveness, and reduced cost.

SUMMARY OF THE INVENTION

In one exemplary embodiment of the invention, a cylinder head for an internal combustion engine defines first and second intake passages for supplying air through first and second intake valve openings to first and second cylinders. The cylinder head also defines first and second exhaust passages for conveying first and second streams of exhaust gas from first and second exhaust valve openings associated with first and second cylinders. The first exhaust valve opening is disposed outboard of the first intake valve opening, and the second exhaust valve opening is disposed outboard of the second intake valve opening.

In another exemplary embodiment of the invention, a cylinder head for an internal combustion engine defines first and second intake passages for supplying air through first and second intake valve openings to first and second cylinders. The cylinder head also defines first and second exhaust passages for conveying first and second streams of exhaust gas from first and second exhaust valve openings associated with first and second cylinders. The first intake valve opening is disposed outboard of the first exhaust valve opening, and the second intake valve opening is disposed outboard of the second exhaust valve opening.

In yet another exemplary embodiment of the invention, an internal combustion engine comprises a cylinder housing defining a first cylinder for reciprocation of a first piston therein and a second cylinder for reciprocation of a second piston therein and a cylinder head coupled to the cylinder housing for sealing the first cylinder and the second cylinder. The cylinder head defines first and second intake passages for supplying air through first and second intake valve openings to first and second cylinders. The cylinder head also defines first and second exhaust passages for conveying first and second streams of exhaust gas from first and second exhaust valve openings associated with first and second cylinders. The first exhaust valve opening is disposed outboard of the first intake valve opening, and the second exhaust valve opening is disposed outboard of the second intake valve opening.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
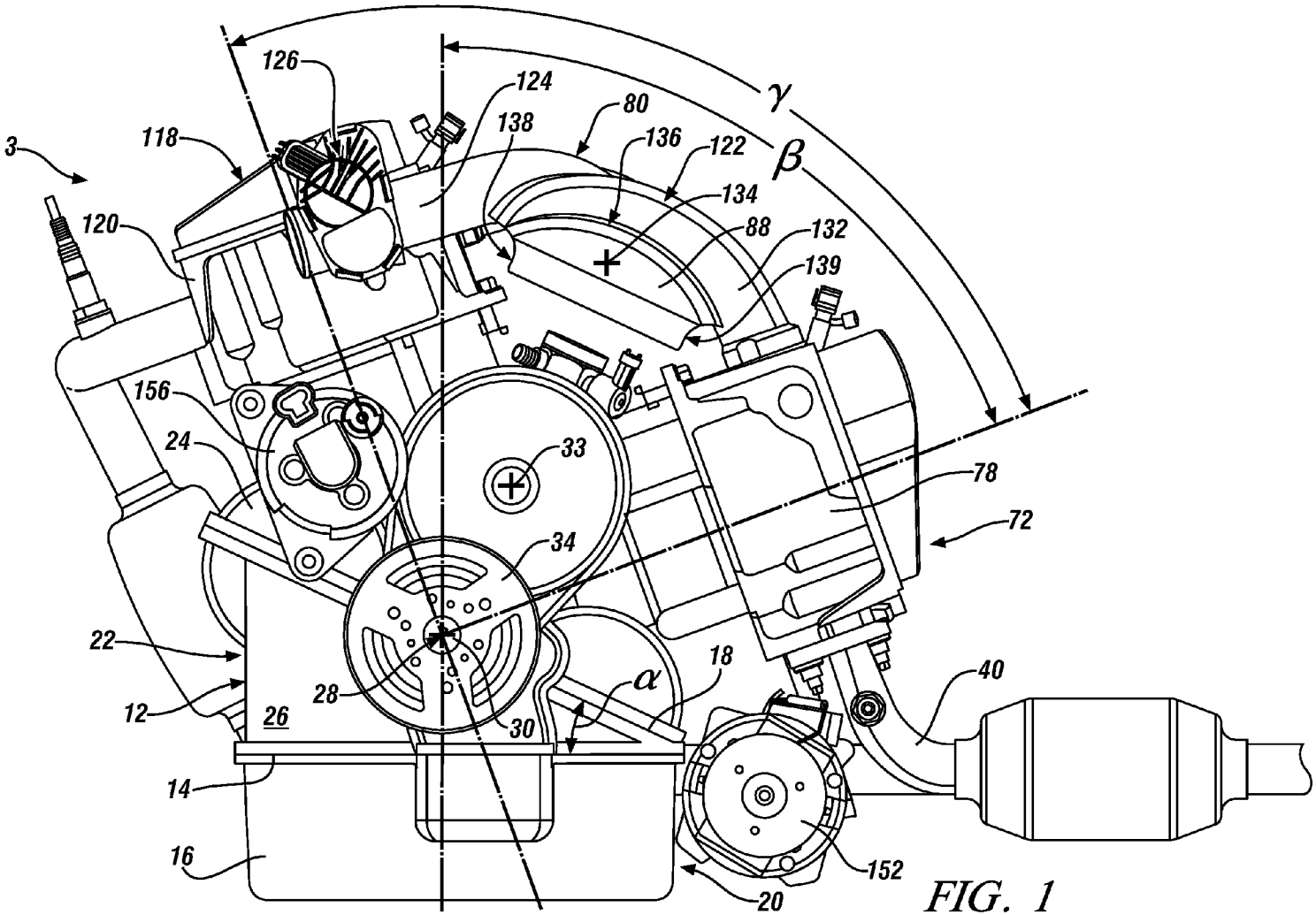
FIG. 1 is a schematic illustration of an internal combustion engine (engine) including a cylinder head having an integrated exhaust manifold according the principles of the invention.

The following description is merely exemplary in nature and is not intended to limit the present disclosure, its application or uses. It should be understood that throughout the drawings, corresponding reference numerals indicate like or corresponding parts and features.

In accordance with an exemplary embodiment of the invention, FIG. 1 shows a three-cylinder engine 3 in a V-configuration. The engine 3 includes an engine block assembly 12 having an open lower portion, or rim, 14 that is closed by an oil reservoir, or pan, 16. The upper end 18 of the engine block assembly 12 extends at an angle alpha from the rear 20 of the engine 3 to the front 22 of the engine and is closed by an engine block cover 24. In an exemplary embodiment, it is contemplated that the angle alpha may vary in a range from about 0 degrees to about 45 degrees, depending on the particular vehicle configuration, and other application-driven variables, of the engine 3. The combination of the engine block assembly 12, the oil pan 16, and the engine block cover 24 defines a crankcase 26 that houses and supports a crankshaft 28 and one or more balance shafts (not shown) for rotation therein. The crankshaft 28 is coupled by a belt, chain or gear drive so as to cause a camshaft to rotate about its longitudinal camshaft axis 33. As the camshaft rotates, its eccentric lobes act upon pushrods (not shown) that extend into cylinder heads 72 and 118 for operation of valves 42, 62, FIG. 2, disposed therein.

In an exemplary embodiment, the crankshaft 28 supports a crankshaft pulley 34 that is positioned outwardly from the front of the engine block assembly 12. The crankshaft pulley 34 may be connected via an accessory drive belt (not shown) to various engine-driven accessories, such as an alternator 152, an air conditioner compressor (not shown), an air pump 156, or a combination thereof.

Figure 4:
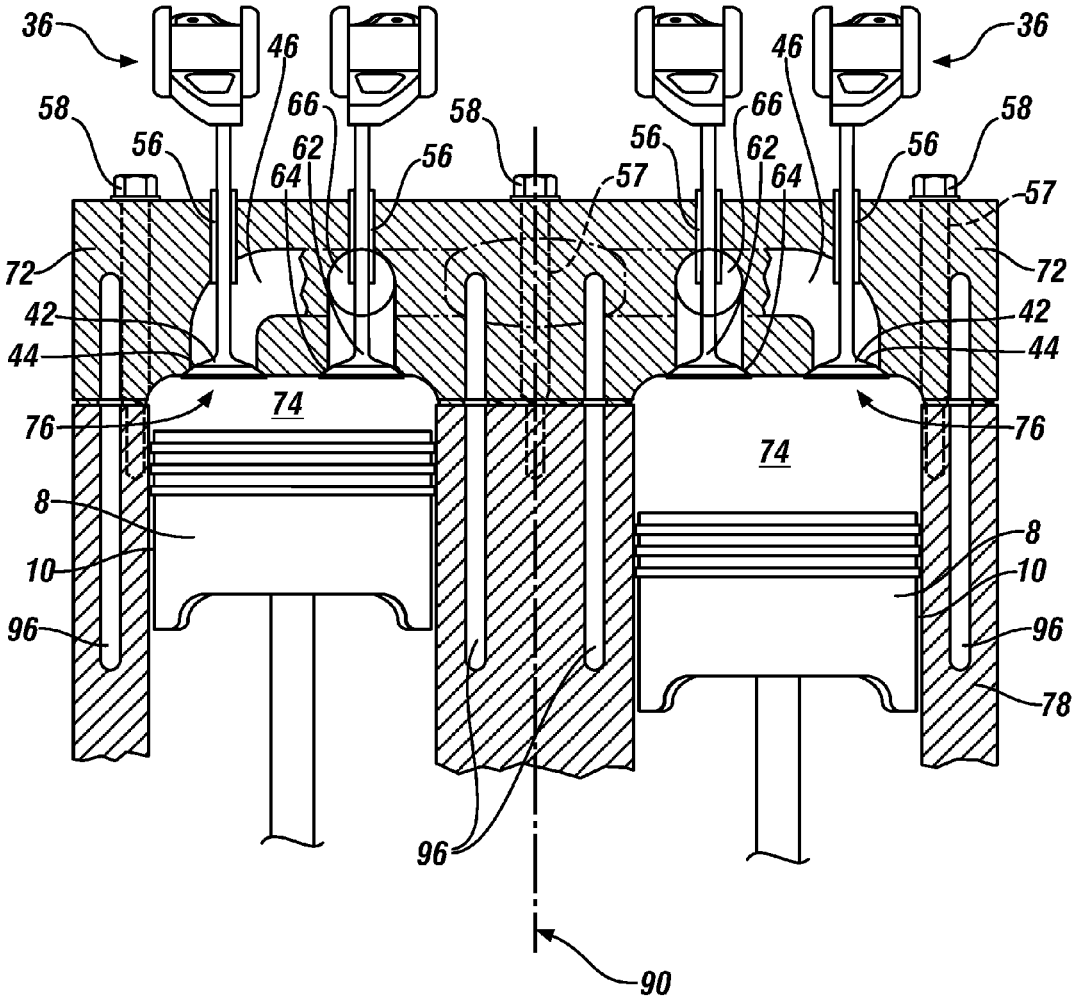
FIG. 4 is a side view of a cylinder head according the principles of the invention.

In an exemplary embodiment, a first cylinder housing 78 defines two cylinders 10, FIG. 4, disposed within the housing 78 for reciprocation of pistons 8 therein. Additionally, a second cylinder housing 120 defines a third engine cylinder 10 disposed within the housing 120 for reciprocation of another piston 8 therein. A first cylinder head 72 closes the upper end of the first cylinder housing 78 and thereby defines a combustion chamber 74 therein. A second cylinder head 118 closes the upper end of the second cylinder housing 120 and thereby defines another combustion chamber therein.

In an exemplary embodiment, the upper end 18 of engine block assembly 12 is angled with the first cylinder housing 78 about an axis of the crankshaft to enable the engine 3 to be efficiently packaged in a vehicle. The particular geometry of the engine 3 depends upon the particular vehicle configuration in which the engine 3 is to be installed and other application driven variables. The third engine cylinder may be arranged at an angle from the two inline cylinders of the first cylinder housing 78, similarly depending upon the particular vehicle configuration and other application driven variables. Such an orientation, as is illustrated in FIG. 1, may allow a V-configured 3-cylinder engine 3 to provide extra power that may be required for certain applications yet may not be available in a dual-cylinder, inline configuration.

An intake assembly 80 is configured to conduct combustion air to the cylinder heads 72, 118. The intake assembly 80 comprises an intake manifold 122 having an intake runner 124 for receiving combustion air through a throttle body 126. The intake runner 124 fluidly connects with and delivers combustion air to a plenum 88 of the intake manifold 122. The plenum 88 extends axially in parallel to the crankshaft axis 30 and defines a plenum axis 134. A plurality of intake runners 132 are in fluid communication with the centrally extending plenum 88 and conduct combustion air to the cylinder heads 72 and 118. More specifically, two of the intake runners 132 extend from the front side 138 of the plenum 88 and around the upper side 136 thereof to fluidly couple with, and deliver combustion air to, the two cylinders of the first cylinder housing 78 through the first cylinder head 72. Alternatively, the intake runner 132 extends from the rear side 139 of the plenum 88 and transitions around the upper side 136 thereof to fluidly couple with, and deliver combustion air to, the single cylinder of the second cylinder housing 120 via the second cylinder head 118.

Thus, the above-described engine 3 provides a V-configured 3-cylinder engine comprising a cylinder housing 78 with two in-line cylinders, and another cylinder housing 120 comprising a single cylinder. It should be appreciated, however, that aspects of this disclosure are equally applicable to engine configurations comprising groupings of the disclosed single-cylinder and dual-cylinder housings. For example, a V-configured 4-cylinder engine comprises a pair of cylinder housings mated with cylinder heads, with each of the cylinder housings defining two cylinders. Another contemplated configuration includes an in-line 4-cylinder engine comprising two cylinder head housing assemblies that are both similar to cylinder housing 78 (with its two in-line cylinders), with both cylinder head assemblies being oriented in line with one another. Another contemplated configuration includes a V-configured 6-cylinder engine comprising a first pair of cylinder head housing assemblies that are both similar to cylinder housing 78 (with its two in-line cylinders) and a pair of cylinder head housing assemblies that are both similar to cylinder housing 120 with its single cylinder). Another contemplated configuration includes a V-configured 8-cylinder engine comprising two pairs of cylinder head housing assemblies that are all similar to cylinder housing 78 (with its two in-line cylinders).

Figure 5:
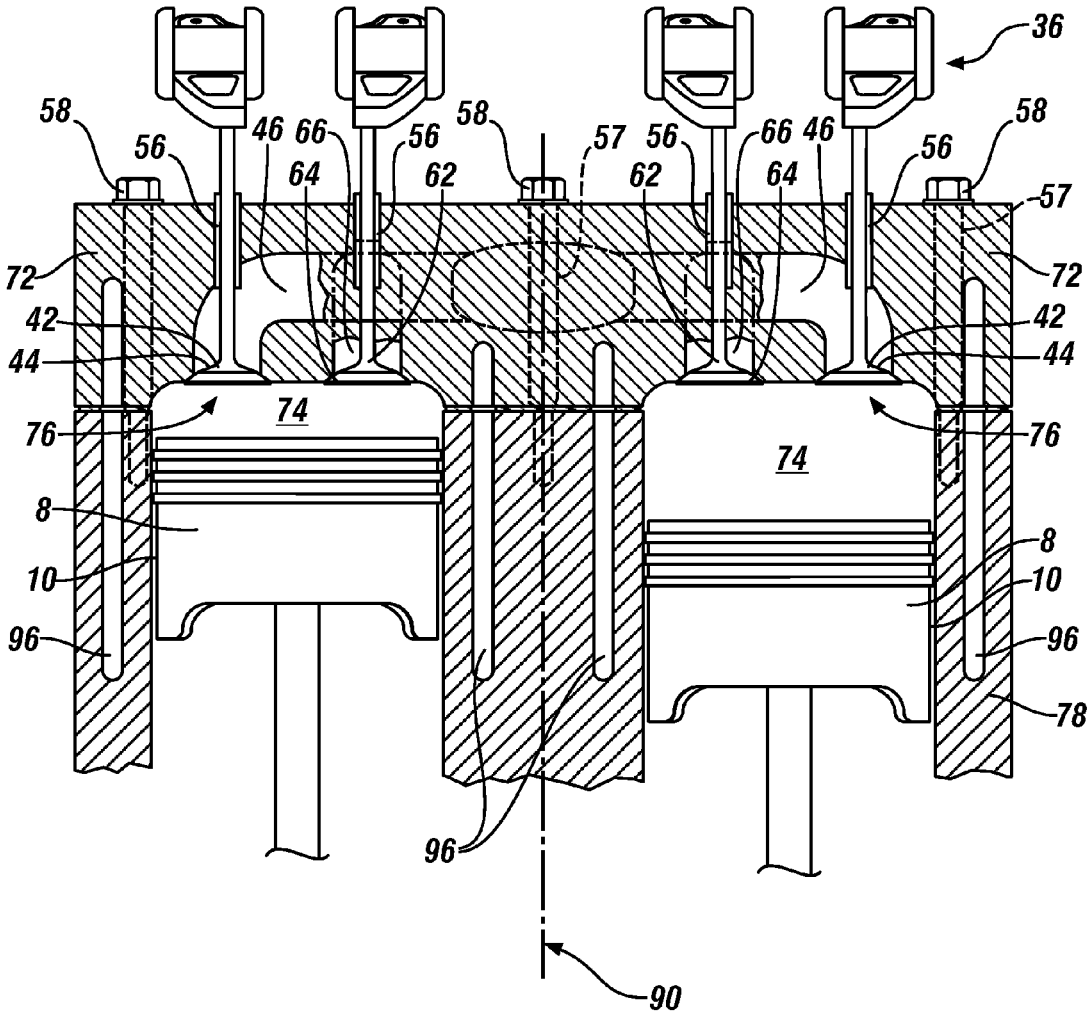
FIG. 5 is a side view of a cylinder head according the principles of the invention.

Referring now to FIG. 4 and FIG. 5, schematic illustrations of side views of exemplary cylinder housing 78 is shown with cylinder head 72 secured thereto. A gasket may be disposed between the cylinder housing 78 and the cylinder head 72. The cylinder housing 78 defines a series of cylinders 10 bored therein. As mentioned above, the number of cylinders 10 in the engine 3 can vary depending on the particular design. For example, the engine can include 2, 3, 4, 6, 7, 10 or 12 cylinders. A piston 8 is slidably disposed within each of the cylinders 10 and is connected to the crankshaft 28. The intake manifold 122 enables a flow of air into the cylinders 10 to mix with fuel injected therein. The fuel/air mixture is combusted within the individual cylinders 10 to produce work that is extracted by the pistons 8 in connection with the crankshaft 28. Coolant is circulated through coolant passages 96 to take up heat from surrounding material to thereby cool the individual cylinders 10.

The cylinders 10 of the cylinder housing 78 are sealed by a cylinder head 72. Cylinder head 72 defines a central plane 90 positioned between two of the cylinders 10. In an exemplary embodiment, the central plane 90 is oriented substantially parallel to a central axis of at least one of the cylinders 10. It should be appreciated that the central plane 90 comprises a plurality of axes disposed between the cylinders 10 and that, in some exemplary embodiments, the central plane 90 comprises a plane of symmetry between the cylinders 10.

Figure 2:
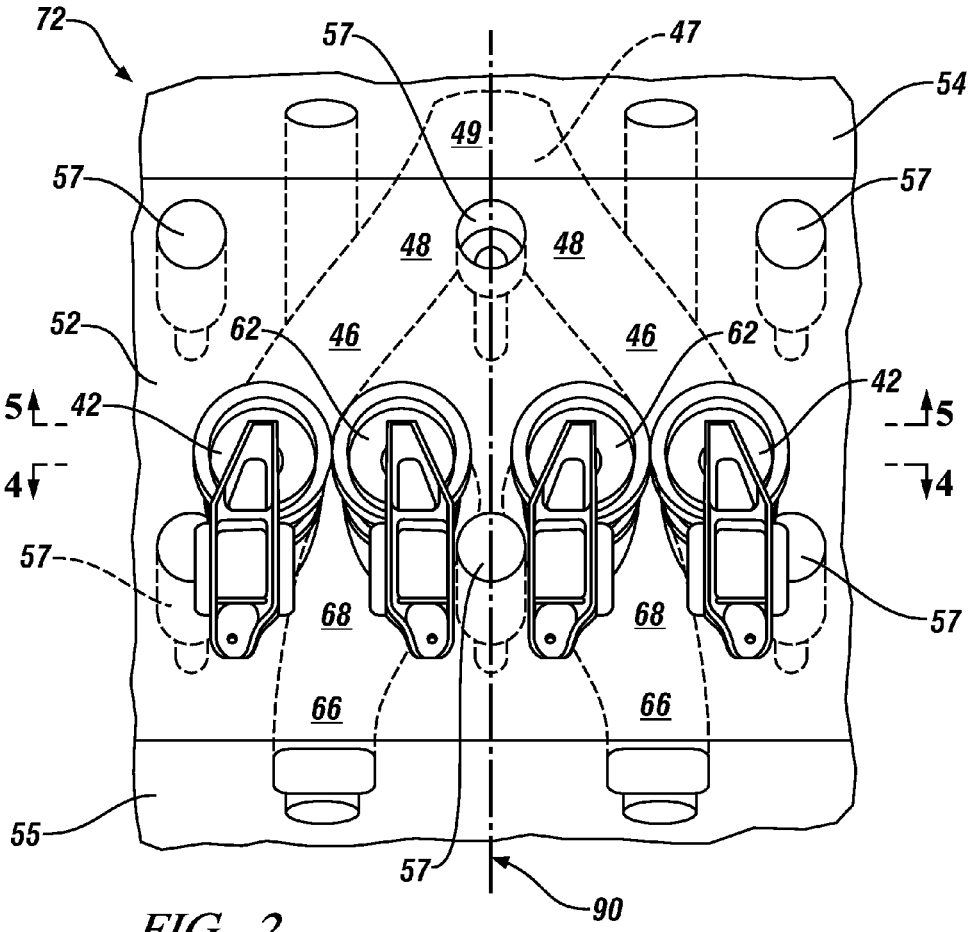
FIG. 2 is a top view of an exemplary cylinder head according the principles of the invention.

With further reference to FIG. 2 and FIG. 5, the cylinder head 72 defines at least two exhaust passages (e.g., first and second exhaust passages) 46 for conveying first and second streams of exhaust gas 48 from first and second exhaust valve openings 44 associated with first and second cylinders 10. The at least two exhaust passages 46 and the corresponding exhaust valve openings 44 are disposed about the central plane 90 and also about an axis lying in the central plane 90. In an exemplary embodiment, the first and second exhaust passages 46 are disposed approximately symmetrically about the central plane 90. In an exemplary embodiment, the first exhaust passage 46 is disposed as an approximate mirror image of the second exhaust passage 46 such that the central plane 90 is a plane of symmetry with respect to the first and second exhaust passages 46. In an exemplary embodiment, the first and second exhaust valves 42 are disposed approximately equidistant from the central plane 90. In an exemplary embodiment, the first exhaust valve 42 (and its corresponding opening 44) is disposed farther from the central plane 90 than the first intake valve 62 (i.e., intake valve opening 64) is disposed from the central plane 90, and the second exhaust valve 42 is disposed farther from the central plane 90 than the second intake valve 62 is disposed from the central plane 90.

With further reference to FIG. 2 and FIG. 4, the cylinder head 72 defines at least two intake passages (e.g., first and second intake passages) 66 for supplying first and second streams of intake gas 68 through first and second intake valve openings 64 to first and second cylinders 10. The at least two intake passages 66 and the corresponding intake valve openings 64 are disposed about the central plane 90 and also about an axis lying in the central plane 90. In an exemplary embodiment, the first and second intake passages 66 are disposed approximately symmetrically about the central plane 90. In an exemplary embodiment, the first intake passage 66 is disposed as an approximate mirror image of the second intake passage 66 such that the central plane 90 is a plane of symmetry with respect to the first and second intake passages 66. In an exemplary embodiment, the first and second intake valves 62 (i.e., valve openings 64) are disposed approximately equidistant from the central plane.

Figure 3:
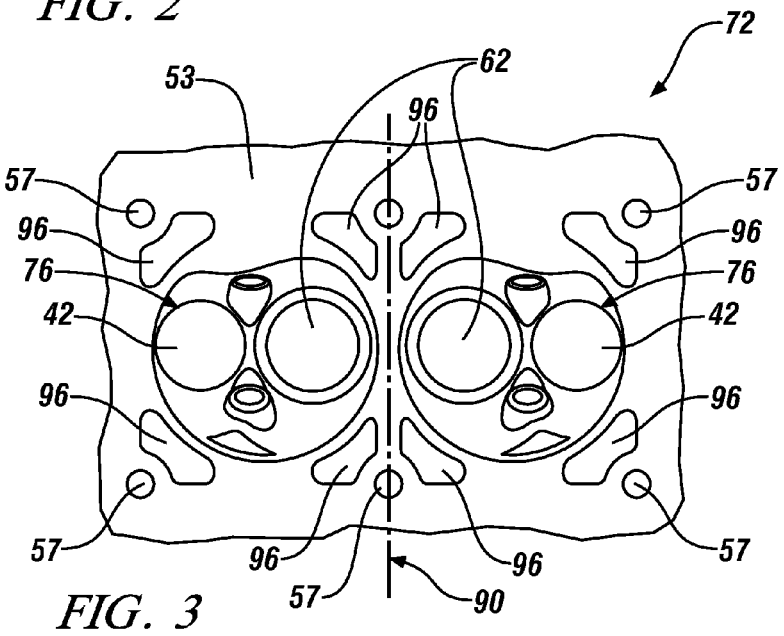
FIG. 3 is a bottom view of an exemplary cylinder head according the principles of the invention.

As shown in FIG. 3, FIG. 4, and FIG. 5, the cylinder head 72 also defines a system of coolant passages 96 disposed around the exhaust passages 46. The system of coolant passages 96 facilitate cooling of the cylinder head 72, particularly in the vicinity of the at least two exhaust passages 46, and the valve-train 36. As the combustion process occurs within each cylinder 10, heat is generated. A radiator or other heat rejection mechanism regulates the temperature of the engine 3 to prevent overheating. In an exemplary embodiment, a flow of coolant is circulated in the cylinder housing 78 through a network of coolant passages 96 to take up heat from, and thereby cool, the individual cylinders 10. As described in further detail below, the coolant is also circulated through coolant passages 96 within the cylinder head 72, particularly in the vicinity of the at least two exhaust passages 46, and the valve-train 36. The coolant is exhausted from the engine 3 and passed through the heat rejection mechanism to remove heat from the coolant, and the coolant is then recycled back through the engine 3.

In an exemplary embodiment, both of the exhaust passages 46 (and their associated valves 42 and valve openings 44) for the cylinders 10 are disposed outboard of (i.e., farther from the plane of symmetry) the corresponding intake passages 66 (and their associated valves 62 and valve openings 64). Put another way, both of the intake passages 66 are disposed inboard from (i.e., more closely proximate the plane of symmetry) the corresponding exhaust passages 46. As a result, despite the presence of a bolt hole 57 to facilitate fastening the cylinder head 72 to the cylinder housing 78 with a bolt 58, increased space is made available for disposing coolant passages 96 around the exhaust passages 46 (e.g., between the exhaust passages 46 and around the bolt hole 57).

Previous designs had required tradeoffs between the sealing benefits provided by symmetric placement of the bolt hole 57 between adjacent cylinders and cooling effectiveness in the vicinity of the exhaust passages 46. The symmetric disposition of exhaust passages 46 outboard of intake passages 66, facilitates symmetric placement of the bolt hole 57 and effective cooling of the exhaust passages 46. These benefits can also facilitate housing of the exhaust manifold 40 within the cylinder head 72 such that the streams of exhaust gas 48 flowing in exhaust passages 46 are collected within the cylinder head 72 into a collected exhaust stream 49 such that the cylinder head 72 provides an integrated exhaust manifold 40 providing a single exhaust vent at the exhaust face 54 of the cylinder head 72.

The cylinder head 72 includes a top face 52 to which the valve-train 36 is fixed. A bottom face 53 of the cylinder head 72 seats against the cylinder housing 78 with the gasket disposed between them. The bottom face 53 includes at least two valve clusters 76 that are each associated with a cylinder 10 and that each define a wall of the combustion chamber 74 of their respective cylinder 10. At least two bolt holes 57 are provided between a pair of valve clusters 76 to provide for a compressive seal between the cylinder housing 78 and the cylinder head 72. The valve clusters 76 each include at least one intake valve opening 64 and at least one exhaust valve opening 44 formed therein. Each of the intake valve openings 64 is in fluid communication with the intake manifold, via an intake passage 66, to enable intake of air into the cylinders 10. Each of the exhaust valve openings 44 is in fluid communication with the exhaust manifold 40, via an exhaust passage 46, to enable exhaust of combustion gas from the cylinders 10.

To facilitate the timed, periodic supply of air (and in some engines, fuel) to each cylinder 10, the cylinder head 72 includes at least one intake valve 62 that is positioned in the stream of intake gas (e.g., air or air and fuel mixture) 68 flowing to that cylinder 10 and that is configured for controlling the flow of air (or fuel and air) into that cylinder 10. Similarly, to facilitate the timed, periodic discharge of products of combustion from each cylinder 10, the cylinder head 72 includes at least one exhaust valve 42 that is positioned in the stream of exhaust gas 48 flowing from that cylinder 10 and that is configured for controlling the flow of combustion products from that cylinder 10. Thus, during each intake event associated with each cylinder 10, a respective intake valve 62 is opened to facilitate the supply of air (and, optionally, combustible fuel) from an intake passage 66 of the cylinder head 72, through the respective intake valve 62, and into the respective cylinder 10. Similarly, during each exhaust event associated with each cylinder 10, a respective exhaust valve 42 is opened to facilitate the discharge of the expanded products of the combusted fuel and air mixture from each respective cylinder 10, through the respective exhaust valve 42, and to a respective exhaust passage 46 of the cylinder head 72.

In an exemplary embodiment, the exhaust passages 46 merge into a collecting area 47 within the cylinder head 72 such that cylinder head 72 incorporates a integrated exhaust manifold 40 providing a single collected exhaust stream 49 discharged at the exhaust face 54 of the cylinder head 72. Each exhaust passage 46 includes a valve bore 56 through which a stem (not shown) of an exhaust valve 42 extends. The exhaust valve 42 is slidably supported through the valve bore 56 to selectively enable flow through its respective exhaust valve opening 44. The collecting area 47 is on an exhaust side of the cylinder head 72 opposite to an intake face 55 that corresponds to the interface between the intake runners of the manifold 122 and the intake passages of the cylinder head 72. The streams of exhaust gas 48 are collected into a collected exhaust stream 49 which is discharged from the cylinder head 72 in a position on the exhaust face 54 that is substantially equidistant from the front and rear of the cylinder head 72, proximate the central plane 90.

The system of coolant passages 96 is cast so as to include geometry formed to accommodate the exhaust passages 46 and intake passages 66. More specifically, the system of coolant passages 96 includes contours that accommodate the exhaust passages 46 as they extend through the cylinder head from the exhaust valve openings 44 to exhaust face 54. The system of coolant passages 96 cools the exhaust passages 46. Fluid communication is facilitated with the system of coolant passages 96 passing through both the cylinder housing 78 and the cylinder head 72. The system of coolant passages 96 may be metered (i.e. have varying diameters, valves, or other mechanisms) to regulate the flow rates therethrough.

Through the mirror-imaged port layout of both the intake passages 66 and the exhaust passages 46, the invention provides a packaged cylinder head for an inline, 2-cylinder engine with an integrated exhaust manifold and good exhaust flow performance. In addition, the invention provides increased area between exhaust passages 46 for improved water jacket design and thus cooling effectiveness, which is of particular benefit for the described V3 engine configuration. As described herein, the cylinder head defines at least two intake passages in fluid communication between runners of an intake manifold and ports of respective cylinders. The cylinder head also defines at least two exhaust passages 46 in fluid communication between exhaust passages 46 of respective cylinders and exhaust passages 46 of an exhaust manifold. Bolt holes 57 are able to be disposed between both intake passages 66 and exhaust passages 46. A plane of symmetry lies between the cylinders, and the exhaust passages 46 are disposed symmetrically about the plane of symmetry. Similarly, intake passages 66 are also disposed symmetrically about the plane of symmetry. Thus, the cylinder head provides a mirrored port layout. Exhaust passages 46 disposed outboard of intake passages 66. Coolant passages 96 are disposed around the exhaust passages 46.

Several advantages are realized by the cylinder head 72 of the invention. Overall cost is reduced as a result of reduced complexity of the exhaust manifold 40. Further, for V-shaped engines identical cylinder head castings can be used for both sides of the engine. This reduces the tooling and variety of castings required because the identical cylinder heads can be used for both sides of the engine.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A cylinder head for sealing at least two cylinders of an internal combustion engine, the cylinder head defining a first intake passage for supplying air through a first intake valve opening to a first cylinder of the at least two cylinders, the first intake passage extending to the first intake valve opening from an intake face of the cylinder head and being disposed for fluid communication, at the intake face, with a first intake runner of a mating intake manifold;

the cylinder head defining a second intake passage for supplying air through a second intake valve opening to a second cylinder of the at least two cylinders, the second intake passage extending to the second intake valve opening from the intake face and being disposed for fluid communication, at the intake face, with a second intake runner of the mating intake manifold;

the cylinder head defining an exhaust vent at an exhaust face of the cylinder head;

the cylinder head defining a first exhaust passage for conveying a first stream of exhaust gas to the exhaust vent from a first exhaust valve opening associated with the first cylinder;

the cylinder head defining a second exhaust passage for conveying a second stream of exhaust gas to the exhaust vent from a second exhaust valve opening associated with the second cylinder;

the exhaust vent being disposed between the first cylinder and the second cylinder;

the first exhaust valve opening being disposed outboard of the first intake valve opening; and the second exhaust valve opening being disposed outboard of the second intake valve opening;

wherein the first cylinder is adjacent to the second cylinder and the first intake valve opening and the second intake valve opening are disposed approximately equidistant from a central plane defined between the first cylinder and the second cylinder and centrally through the exhaust vent.

2. The cylinder head of claim 1, wherein the first exhaust valve opening and the second exhaust valve opening are disposed approximately equidistant from a central plane defined between the first cylinder and the second cylinder.

3. The cylinder head of claim 1, wherein the first exhaust valve opening is disposed farther from a central plane defined between the first cylinder and the second cylinder than the first intake valve opening is disposed from the central plane, and wherein the second exhaust valve opening is disposed farther from the central plane than the second intake valve opening is disposed from the central plane.

4. The cylinder head of claim 1, wherein the first intake passage and the second intake passage are disposed approximately symmetrically about the central plane.

5. The cylinder head of claim 1, wherein the first exhaust passage and the second exhaust passage are disposed approximately symmetrically about the central plane.

6. The cylinder head of claim 1, wherein the first intake passage is disposed as an approximate mirror image of the second intake passage such that the central plane is a plane of symmetry with respect to the first intake passage and the second intake passage.

7. The cylinder head of claim 1, wherein the first exhaust passage is disposed as an approximate mirror image of the second exhaust passage such that the central plane is a plane of symmetry with respect to the first exhaust passage and the second exhaust passage.

8. The cylinder head of claim 1, wherein the cylinder head defines a hole positioned between the first cylinder and the second cylinder to facilitate joining the cylinder head to a housing that encloses the first cylinder and the second cylinder.

9. The cylinder head of claim 1, wherein the cylinder head defines a hole positioned on the central plane to facilitate joining the cylinder head to a housing that encloses the first cylinder and the second cylinder.

10. The cylinder head of claim 1, wherein the cylinder head defines a system of coolant passages disposed around the first exhaust passage and the second exhaust passage to facilitate cooling of the cylinder head in the vicinity of the first exhaust passage and the second exhaust passage.

11. The cylinder head of claim 1, wherein the first stream of exhaust gas and the second stream of exhaust gas are collected within the cylinder head into a collected exhaust stream, and wherein the cylinder head defines a single exhaust port for delivering the collected exhaust stream to an exhaust system associated with the engine.

12. An internal combustion engine comprising:

a cylinder housing defining a first cylinder for reciprocation of a first piston therein and a second cylinder for reciprocation of a second piston therein; and a cylinder head coupled to the cylinder housing for sealing the first cylinder and the second cylinder;

the cylinder head defining a first intake passage for supplying air through a first intake valve opening to the first cylinder, the first intake passage extending to the first intake valve opening from an intake face of the cylinder head and being disposed for fluid communication, at the intake face, with a first intake runner of a mating intake manifold;

the cylinder head defining a second intake passage for supplying air through a second intake valve opening to the second cylinder, the second intake passage extending to the second intake valve opening from the intake face and being disposed for fluid communication, at the intake face, with a second intake runner of the mating intake manifold;

the cylinder head defining an exhaust vent at an exhaust face of the cylinder head;

the cylinder head defining a first exhaust passage for conveying a first stream of exhaust gas to the exhaust vent from a first exhaust valve opening associated with the first cylinder;

the cylinder head defining a second exhaust passage for conveying a second stream of exhaust gas to the exhaust vent from a second exhaust valve opening associated with the second cylinder;

the exhaust vent being disposed between the first cylinder and the second cylinder;

the first exhaust valve opening being disposed outboard of the first intake valve opening; and the second exhaust valve opening being disposed outboard of the second intake valve opening;

the first cylinder being adjacent to the second cylinder and the first intake valve opening and the second intake valve opening are disposed approximately equidistant from a central plane defined between the first cylinder and the second cylinder and centrally through the exhaust vent.

13. The internal combustion engine of claim 12, wherein the first exhaust valve opening and the second exhaust valve opening are disposed approximately equidistant from a central plane defined between the first cylinder and the second cylinder.

14. The internal combustion engine of claim 12, wherein the first exhaust valve opening is disposed farther from a central plane defined between the first cylinder and the second cylinder than the first intake valve opening is disposed from the central plane, and wherein the second exhaust valve opening is disposed farther from the central plane than the second intake valve opening is disposed from the central plane.

15. The internal combustion engine of claim 12, wherein the first intake passage and the second intake passage are disposed approximately symmetrically about the central plane.

16. The internal combustion engine of claim 13, wherein the first exhaust passage and the second exhaust passage are disposed approximately symmetrically about the central plane.

17. The internal combustion engine of claim 12, wherein the first stream of exhaust gas and the second stream of exhaust gas are collected within the cylinder head into a collected exhaust stream, and wherein the cylinder head defines a single exhaust port for delivering the collected exhaust stream to an exhaust system associated with the engine.

* * * * *